United States Patent [19]

Yuasa et al.

[11] Patent Number: 4,812,208

[45] Date of Patent: Mar. 14, 1989

[54] HEADBOX FOR PAPER MACHINE WITH PARALLEL TWISTED PLATES

[75] Inventors: Masami Yuasa; Kazumi Abe, both of Tokyo; Masaji Shibamoto, Yokohama; Masahiro Yakabe, Narita, all of Japan

[73] Assignee: Seishi Gijutsu Kenkyu Kumiai, Tokyo, Japan

[21] Appl. No.: 98,716

[22] Filed: Sep. 21, 1987

Related U.S. Application Data

[63] Continuation of Ser. No. 888,845, Jul. 24, 1986, abandoned.

[30] Foreign Application Priority Data

Jul. 30, 1985 [JP] Japan ..... 60-166813

[51] Int. Cl.[4] ..... D21F 1/02

[52] U.S. Cl. ..... 162/343; 162/336; 162/344

[58] Field of Search ..... 162/336, 343, 344, 345, 162/346, 347

[56] References Cited

U.S. PATENT DOCUMENTS

| | | | |
|---|---|---|---|
| 3,328,236 | 6/1967 | Burgess, Jr. et al. | 162/343 |
| 3,607,625 | 9/1977 | Hill et al. | 162/343 |
| 3,839,149 | 10/1974 | Justus et al. | 162/347 |
| 3,843,470 | 10/1974 | Betley et al. | 162/343 |
| 4,504,360 | 3/1985 | Fujiwari | 162/343 |
| 4,604,164 | 8/1986 | Fujiwari et al. | 162/343 |

FOREIGN PATENT DOCUMENTS

| | | | |
|---|---|---|---|
| 809927 | 4/1969 | Canada | 162/343 |
| 93895 | 7/1980 | Japan . | |

*Primary Examiner*—David L. Lacey
*Assistant Examiner*—K. M Hastings

[57] ABSTRACT

A plurality of stages of parallel twisted plates extend in a slurry passage adjacent to a slice outlet of a head box in the direction of papermaking slurry flow therethrough and are spaced apart from each other by a predetermined distance. The twisted plates directly cause the slurry flowing through the head box to swirl. Adjacent vortex flows of the slurry interfere with each other, resulting in the violent agitation of the slurry.

7 Claims, 7 Drawing Sheets

HEADBOX FOR PAPER MACHINE WITH PARALLEL TWISTED PLATES

This application is a continuation of application Ser. No. 888,845, filed July 24, 1986, now abandoned.

BACKGROUND OF THE INVENTION

The present invention relates to a head box for a paper machine for continuously feeding the papermaking slurry onto the endless forming wire cloth or fabric which is rotated.

In order to obtain a sheet of paper which is uniform in the widthwise direction and has a high degree of strength in the lengthwise direction, papermaking slurry must be fed such that fibers in the slurry are spread to prevent flocking thereof and that the fibers are oriented in a direction of the papermaking slurry flow.

In view of the above, there has been proposed an arrangement as shown in FIG. 19 in which a plurality of papermaking slurry feed tubes 2 are disposed in parallel with each other within a head box 1 and a ribbon-shaped twisted plate 3 is fitted into each tube 2 so that the slurry flowing through the tube 2 is caused to swirl (Japanese Patent First Publication No. 93895/1980). The slurry discharged out of the respective slurry tubes 2 is joined and caused to issue through a slice outlet 4 onto a wire cloth or fabric 5. When an ordinary papermaking slurry having a low concentration is fed through the head box 1 of the type described above onto the wire cloth or fabric 5, the fibers in the slurry are satisfactorily dispersed, uniformly spread in the widthwise direction and oriented in a direction of travel of the wire cloth or fabric 5.

However, when a highly concentrated papermaking slurry is supplied to the head box 1, the slurry cannot be dispersed satisfactorily and it is not possible to make uniform paper. For highly concentrated slurry, not only strong agitation is necessary, but also agitation should be kept to the vicinity of the slice outlet, because the slurry causes re-flocking in very short time. If the head box shown in FIG. 19 is used, for satisfactory dispersion of fiber, it is necessary to adopt very high flow velocity through the tubes. However the high velocity causes large-scale turbulence at outlet of tubes and causes streak at slice outlet. In order to stabilize the turbulence, long distance between tube outlet and slice outlet is necessary and this results that slurry easily flocks again.

When the slurry tube 2 is reduced in diameter so as to suppress the disturbance of the discharged slurry, there arises the problem that the slurry clogs the slurry tube 2.

The present invention was made to overcome the above and other problems encountered in the conventional paper machines and has for its object to provide a head box which can cause a papermaking slurry even at a high concentration to swirl sufficiently so that a sheet of paper having a uniform quality in the widthwise direction and a high degree of strength in the lengthwise direction can be fabricated.

DETAILED DESCRIPTION OF THE PREFERRED EMBODIMENTS

Preferred embodiments of the present invention will be described in detail with reference to the accompanying drawings.

Figure 1:
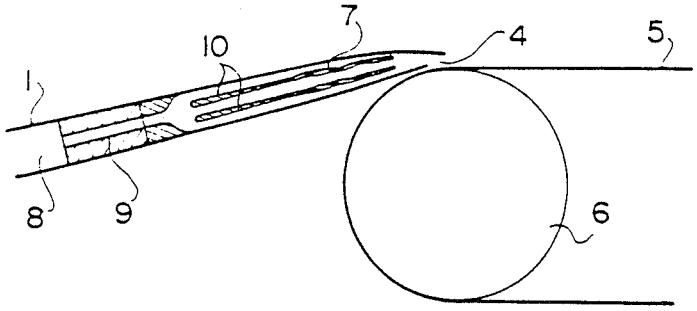
FIG. 1 is a longitudinal sectional view of a first embodiment of a head box for a paper machine in accordance with the present invention.

FIG. 1 shows a first embodiment of the present invention in which a head box 1 has a slice outlet 4 at its downstream end which is adjacent to a wire cloth or fabric 5 wrapped on a roller 6 in the direction of travel of the wire cloth or fabric 5. A plurality of ribbon-shaped twisted plates 7 extend in the passage of the head box adjacent to the slice outlet 4 in the direction of the papermaking slurry flow and are spaced apart from each other by a predetermined distance so that the papermaking slurry flowing from the inlet 8 toward the slice outlet 4 is forced to swirl. Straightening tubes 9 are in parallel with each other along the widthwise direction of the head box 1 on the upstream side of the twisted plates 7 so that the papermaking slurry can be uniformly distributed in the widthwise direction.

Figure 2A:
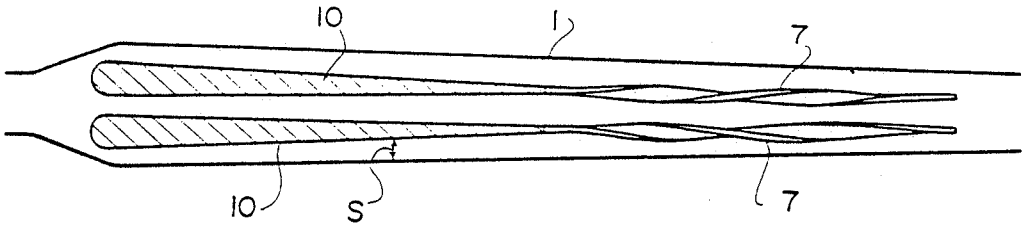
FIG. 2*a* is a fragmentary view, on enlarged scale, thereof.
Figure 2B:
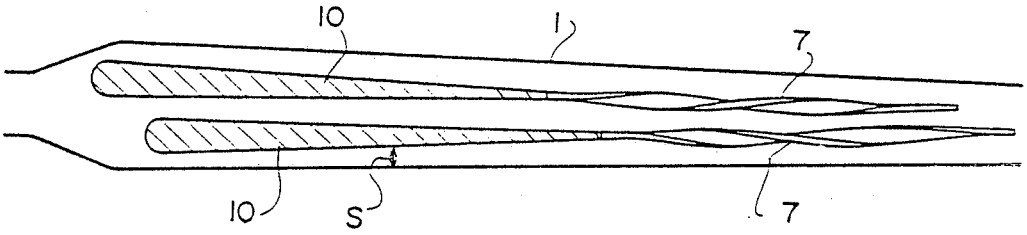
FIG. 2*b* is a modification thereof.
Figure 3:
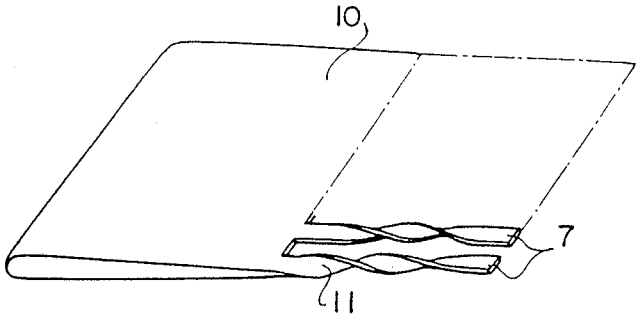
FIG. 3 is a perspective view of a twisted plate.

As shown in FIG. 3, a streamline-shaped base plate 10 having cross sectional area gradually reduced from its upstream end toward downstream end is cut at the downstream end to form a plurality of ribbon-shaped plates 11 spaced apart from each other in the widthwise direction by a predetermined distance. These ribbon-shaped plates 11 are twisted to form twisted plates 7. The twisted plates 7 are disposed in the head box 1 such that the lateral sides of the base plate 10 are securely attached to the side walls of the head box 1. It is to be understood that, as shown in FIG. 2*a*, the twisted plates 7 may be disposed in two or more stages and spaced apart from each other in the vertical and horizontal direction by a predetermined distance. And as shown in FIG. 2*b*, base plates with twisted plates may be staggeredly arranged in flow direction. As also shown in the figures the plate 7 are completely twisted about their respective longitudinal axes.

Next the mode of operation of the head box 1 of the type explained above will be described. The cross sectional area of the papermaking slurry passage between the base plates 10 as well as the cross sectional area in terms of the width S of the slurry passages defined between the base plate 10 and the upper or bottom wall of the head box 1 are increased gradually in the direction of the papermaking slurry flow in the head box so that the flow velocity of the slurry is decreased and the separation of the flow of the slurry from the boundary layer occurs, resulting in the turbulent flow. The slurry in the turbulent state is forced to swirl directly by twisted plates 7 and the adjacent turbulent flows of the slurry interfere with each other. As a result, the flow of the slurry is disturbed three-dimentionally so that the fibers can be satisfactorily dispersed even if the papermaking slurry has a high concentration. Therefore, the slurry is discharged through the slice outlet 4 on the wire cloth or fabric 5 such that the slurry is uniformly distributed in the widthwise direction and the fibers are oriented in the direction of travel of the wire cloth or fabric 5. As a consequence, a sheet of paper which is uniform in the widthwise direction and which has a high degree of strength in the lengthwise direction can be obtained.

Distribution of fibers can be freely selected by selecting the distance between the adjacent twisted plates 7, the number of vertical stages of the plates 7, the number of longitudinal lows of the plates 7, the length and thickness of the plates 7 and the direction in which the plates 7 are twisted.

Figure 4:
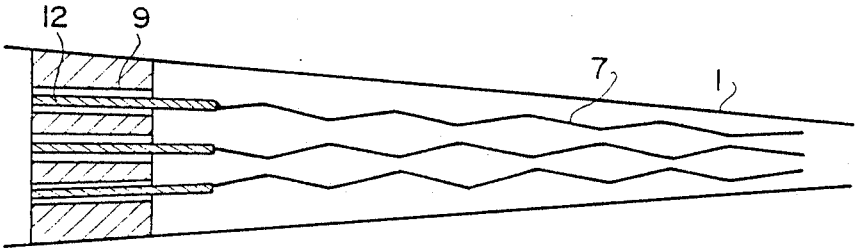
FIG. 4 is a schematic longitudinal sectional view of a modification of the first embodiment.
Figure 5:
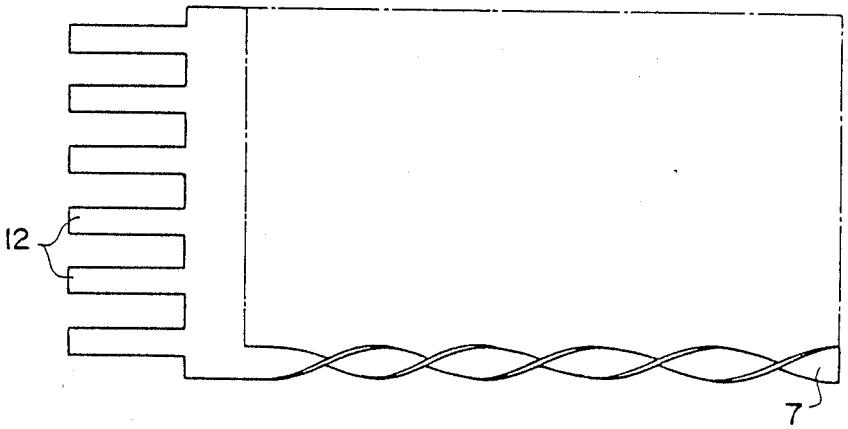
FIG. 5 is a top view of a twisted plate thereof.
Figure 6:
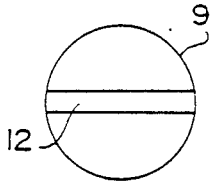
FIG. 6 is a front view illustrating a leg of the twisted plate fitted into a straightening tube.
Figure 7:
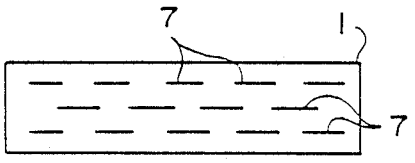
FIG. 7 is a schematic cross sectional view illustrating the arrangement of twisted plates.

In lieu of the streamline-shaped base plate 10 for providing the twisted plates 7 in the head box 1, a plate member with legs 12 may be used which has a plurality of parallel twisted plates 7 extending downstream as shown in FIG. 5. Each leg 12 at the upstream end of the plate member is securely inserted into each straightening tube 9 as shown in FIG. 6, whereby the twisted plates 7 are supported as shown in FIG. 4. When a plurality of twisted plate stages are installed in the vertical direction in the head box 1, they may be disposed one immediately over another or, as shown in FIG. 7, they may be staggered in the vertical direction. The width of the ribbon-shaped plate 11 may be increased or decreased gradually in the downstream direction. Alternatively the width of the ribbon-shaped plate 11 may be gradually decreased in the upstream portion of the plate 11 and the width in the downstream portion thereof may remain unchanged. In other words, the ribbon-shaped plate 11 may be designed and fabricated depending upon a desired distribution of fibers in the slurry.

Figure 8:
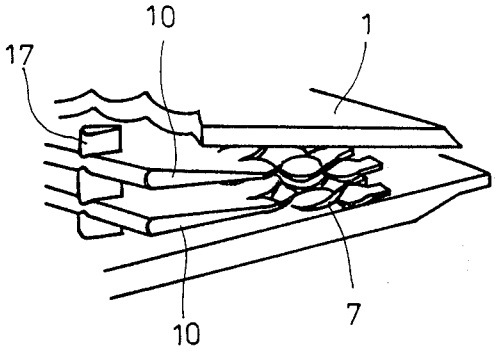
FIG. 8 is a perspective sectional view of a modification in which a head box is provided at its base plates with supporting posts.

Further, as shown in FIG. 8, supporting posts 17 may be disposed in a spaced-apart relationship to support the base plate 10 to prevent the deflection due to its own weight in the case of a considerably widened head box.

Figure 9:
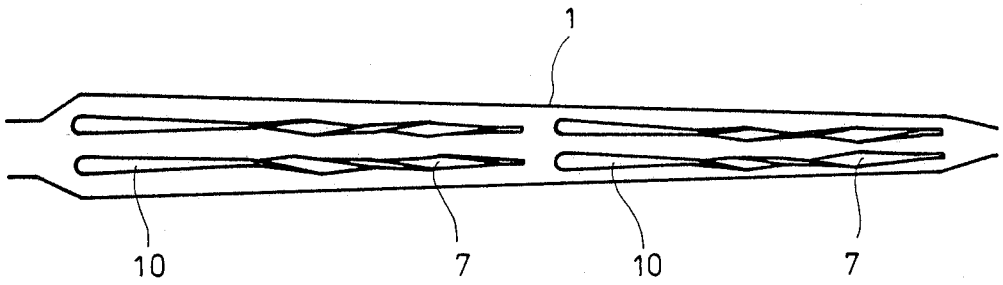
FIG. 9 is a longitudinal sectional view of another modification of the first embodiment.

In addition, a plurality of twisted plate groups may be disposed in two or more stages in the flow direction of the head box 1 (see FIG. 9).

Figure 10:
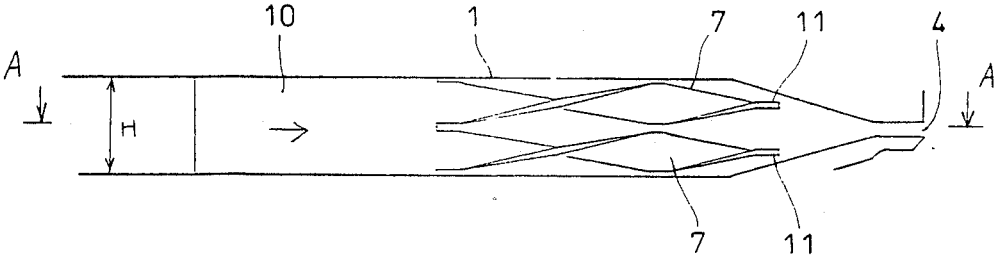
FIG. 10 is a fragmentary view, on enlarged scale, of the second embodiment of the present invention.
Figure 11:
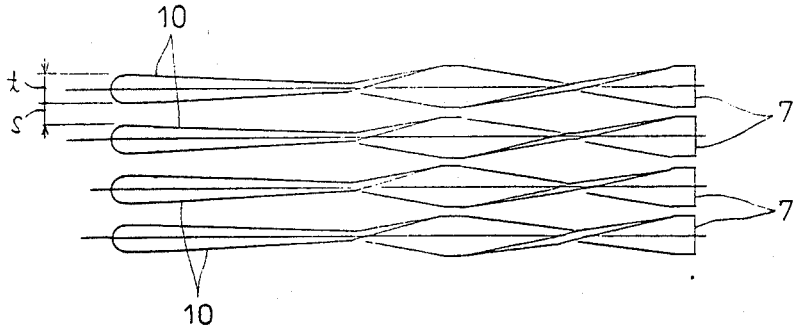
FIG. 11 is a sectional view taken along the line A—A of FIG. 10.

FIG. 10 shows the second embodiment of the present invention in which the head box 1 has the papermaking slurry passage with the height H. A plurality of base plates 10 each of which provides the twisted plates 7 are disposed upright and spaced apart from each other in the widthwise direction by a suitable distance in the head box 1 as shown in FIGS. 10 and 11. The twisted plate 7 for causing the papermaking slurry to swirl extends from the downstream end of the base plate 10 toward the slice outlet 4. The thickness t of the base plates 10 is decreased in the direction of the slurry flow so that the width S of the slurry passages is increased in the direction of the slurry flow, whereby the flow velocity of the slurry flowing through the passage defined between the adjacent base plates 10 is gradually decreased and the vortex flow is produced. In the embodiment shown, the twisted plates 7 are formed by twisting two ribbon-shaped plates 11 extending integrally from the downstream end of the base plate 10 at the same pitch and in the same direction.

In operation the flow velocity of the slurry is gradually decreased since the cross sectional area in terms of the width S of the slurry passage defined between the adjacent base plates 10 is gradually increased in the direction of the papermaking slurry flow through the head box 1, so that the boundary layer is separated, resulting in the turbulent flow. Thereafter the turbulent flow becomes the vortex flow because the slurry flows through the passages defined by the twisted plates which are spaced apart from each other in the vertical and horizontal directions. The adjacent vortex flows interfere with each other so that the slurry is caused to flow in three-dimentionally random directions. As a consequence, the fibers can be satisfactorily dispersed and distributed even in the slurry having a high concentration so that the slurry can be discharged through the slice outlet 4 on the wire cloth or fabric 5 such that the fibers are uniformly distributed in the widthwise direction and oriented in the direction of travel of the wire cloth or fabric 5. Thus, a sheet of paper which is uniform in the widthwise direction and which has a high degree of strength in the lengthwise direction can be produced.

The base plates 10 for providing the twisted plates 7 are disposed upright in the head box 1 in a spaced-apart relationship in the widthwise direction so that there is no fear that the base plates 10 are deflected by their own weights. This means that there is no limit on a maximum width of the head box 1 and that there is no fear that the base plates 10 are caused to deform themselves and vibrate. Furthermore, the base plates 10 straighten the flow of the slurry.

The step for fabricating twisted plates demands a precise manual operation so that it is very difficult to twist smaller ribbon-shaped plates extending from a larger base plate 10. However, according to the embodiment, the base plates small in size are used and erected upright so that the fabrication steps are facilitated, the fraction defective can be reduced and the replacement of parts is facilitated.

The distance between the adjacent base plates 10 and the number of stages and lows, length, pitch and twisting direction of the twisted plates 7 may be changed to control the distribution of fibers in the slurry.

Figure 12:
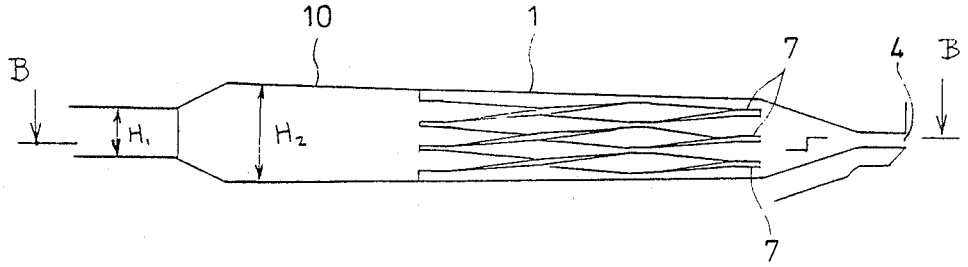
FIG. 12 is a longitudinal sectional view of a modification in which the height of passages in the head box is varied.
Figure 13:
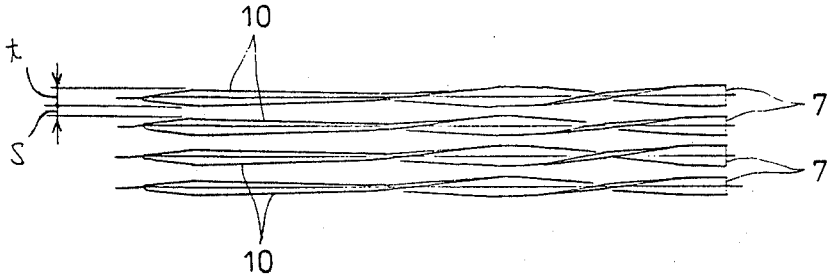
FIG. 13 is a sectional view taken along the line B—B of FIG. 12.
Figure 14:
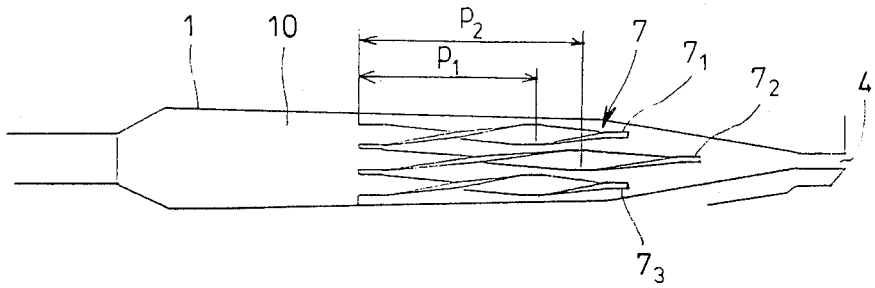
FIG. 14 is a longitudinal sectional view of a modification in which the twisted plate is changed in length and pitch.

FIGS. 12 and 13 show a modification in which the height of the slurry passage in the head box is increased from $H_1$ to $H_2$ ad the thickness t of the base plate 10 is initially increased and then decreased toward downstream, resulting in the gradually enlarged slurry passage, and the twisted plates 7 are arranged in three stages. FIG. 14 shows a modification in which, of the three-stage twisted plates 7, the center twisted plate $7_2$ is longer than the other twisted plates $7_1$ and $7_3$ and has a pitch $P_2$ longer than a pitch $P_1$ of the upper and lower twisted plates $7_1$ and $7_3$.

Figure 15:
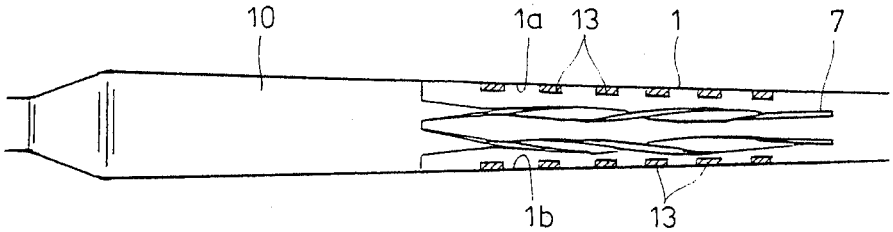
FIGS. 15 and 16 are longitudinal sectional views of modifications in which the passage walls and/or the base plates are provided with projections and/or grooves.
Figure 16:
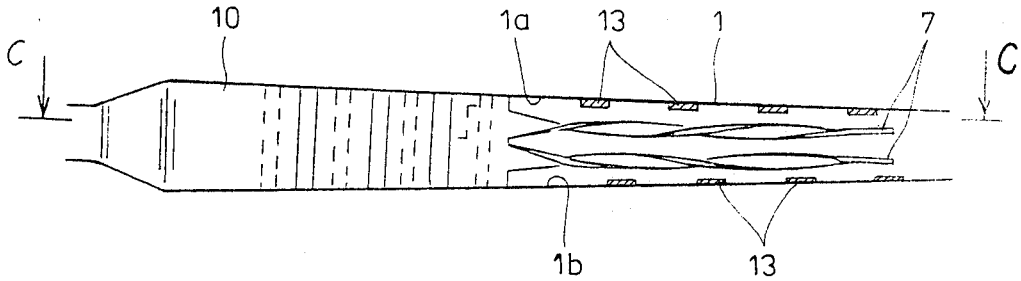
Figure 17:
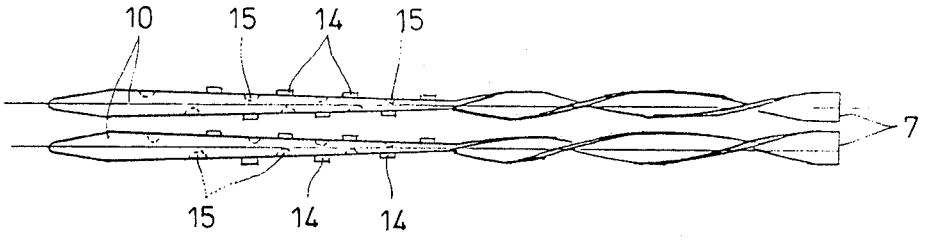
FIG. 17 is a sectional view taken along the line C—C of FIG. 16.
Figure 18:
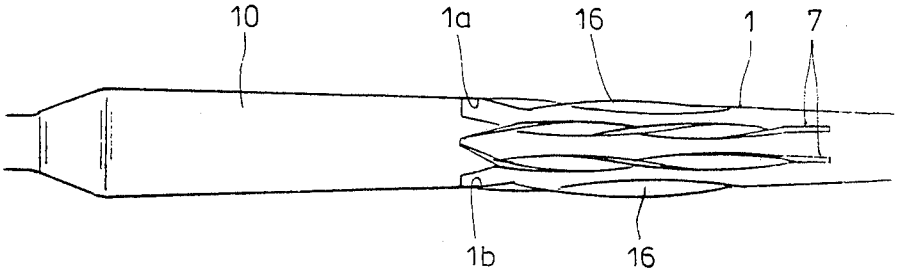
FIG. 18 is a longitudinal sectional view of a further modification in which top and bottom walls of the head box adjacent to the outlet are formed with twisted grooves.
Figure 19:
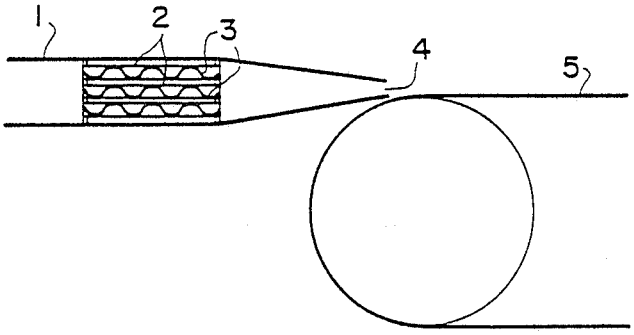
Fig.19 PRIOR ART
FIG. 19 is a longitudinal sectional view of a conventional head box.

In order to prevent the papermaking slurry from flowing straight along the top and bottom walls of the head box 1 without being disturbed, continuous or discrete projections 13 may provide in the widthwise direction on the top and bottom walls 1*a* and 1*b* of the head box 1 and spaced apart from each other by a suitable distance in the direction of the slurry flow through the head box 1 as shown in FIG. 15. Additionally, as shown in FIGS. 16 and 17, continuous or discrete projections 14 and/or grooves 15 may be formed vertically on the base plate 10. FIG. 18 shows a further modification in which twisted grooves 16 are formed on the top and bottom walls 1*a* and 1*b* of the head box 1 in corresponding relationship with the twisted plates 7.

The effects, features and advantages of the present invention may be summarized as follows:

(1) A plurality of parallel ribbon-shaped twisted plates extend in the slurry passage within the head box adjacent to the slice outlet thereof and are spaced apart from each other by a predetermined distance so that they directly force the papermaking slurry flowing through the head box to swirl. In addition, the adjacent vortex flows interfere with each other so that the slurry is further agitated. Even when the papermaking slurry has a high concentration, it encounters less flow resistance and the fibers in the slurry are forced to swirl and be satisfactorily dispersed and distributed in the direction of the slurry flow.

(2) As a result, a high concentration papermaking slurry can be issued on the wire cloth or fabric such that the fibers are uniformly distributed in the widthwise direction without being flocked and are oriented in the direction of travel of the wire cloth or fabric. Therefore, sheets of paper which are uniform in the widthwise direction and which exhibit a high strength in the lengthwise direction can be produced.

What is claimed is:

1. In a headbox for a papermaking machine having an inlet for papermaking slurry, a passage, a slice outlet for the papermaking slurry, and a plurality of straightening tubes placing the inlet in flow communication with the passage, the improvement comprising: a plurality of base plate means disposed in said passage downstream of the tubes in the direction of the flow of the papermaking slurry and having a thicker cross section toward the straightening tubes and a thinner cross section toward the slice outlet, whereby the cross section of said passage gradually increases downstream; twisted plate means connected to said base plate means and comprising a plurality of parallel spaced ribbon-shaped plates extending in said passage adjacent to said slice outlet in the direction of flow of the papermaking slurry, each plate being substantially rectangular with a longitudinal axis and being completely twisted about its respective longitudinal axis several times, to thereby cause the slurry to swirl in the direction of flow of the slurry and cause three dimensional dispersion of the slurry.

2. The headbox according to claim 1, wherein said base plate means are disposed horizontally and spaced apart from each other.

3. the headbox according to claim 1, wherein said twisted plate means extend from said base plate means which in turn are disposed upright and are spaced apart from each other.

4. The headbox according to claim 1, wherein supporting posts are disposed independently of said straightening tubes between adjacent base plate means and between said base plate means and said passage, to prevent bending of the base plate means.

5. In a headbox for papermaking machine having an inlet for papermaking slurry, a passage, a slice outlet for the papermaking slurry, and a plurality of straightening tubes placing the inlet in flow communication with the passage, the improvement comprising: a plurality of plate member means having at an upstream end thereof a plurality of legs respectively located within the straightening tubes such that said legs are arranged flatly without twisting in the respective straightening tube; twisted plate means provided at the downstream end of said plate member means and comprising a plurality of parallel spaced ribbon-shaped plates extending in said passage adjacent to said slice outlet in the direction of flow of the papermaking slurry, each plate being substantially rectangular with a longitudinal axis and being completely twisted about its respective longitudinal axis several times, to thereby cause the slurry to swirl in the direction of the slurry flow and cause three dimensional dispersion of the slurry.

6. The headbox according to claim 5, wherein said plate member means are disposed horizontally and spaced apart from each other.

7. The headbox according to claim 5, wherein said twisted plate means extend from said plate member means which in turn are disposed upright and are spaced apart from each other.

* * * * *